United States Patent [19]

Lyon

[11] Patent Number: 4,854,235

[45] Date of Patent: Aug. 8, 1989

[54] PORTABLE HAND-OPERATED STAMPS

[76] Inventor: Donald A. Lyon, R.D. 4, Box 2A, Norwich, N.Y. 13815

[21] Appl. No.: 88,708

[22] Filed: Aug. 24, 1987

Related U.S. Application Data

[63] Continuation of Ser. No. 798,808, Nov. 18, 1985, abandoned, which is a continuation-in-part of Ser. No. 627,686, Jul. 5, 1984, abandoned.

[51] Int. Cl.[4] ..... B41F 27/02; B41K 1/56

[52] U.S. Cl. ..... 101/389.1; 101/405

[58] Field of Search ..... 101/333, 382 MV, 396, 101/398, 399, 405, 406, 389.1; 40/328

[56] References Cited

U.S. PATENT DOCUMENTS

| | | | |
|---|---|---|---|
| 383,321 | 5/1888 | Reynolds | 101/406 |
| 1,108,314 | 8/1914 | Anderson | 101/405 |
| 1,972,953 | 9/1934 | Reynolds | 101/405 X |
| 2,038,338 | 4/1936 | Baumgarten | 101/333 X |
| 2,176,160 | 10/1939 | Uhl | 101/405 X |
| 2,899,895 | 8/1959 | Tannery | 101/405 X |
| 3,810,055 | 5/1974 | Wright | 101/382 MV X |
| 4,078,031 | 3/1978 | Bishop | 101/382 MV X |
| 4,221,164 | 9/1980 | Krulwich | 101/405 X |

FOREIGN PATENT DOCUMENTS

| | | | |
|---|---|---|---|
| 1235492 | 5/1960 | France | 101/405 |
| 276169 | 6/1951 | Switzerland | 101/405 |
| 1505548 | 3/1978 | United Kingdom | 101/382 MV |
| 1574908 | 9/1980 | United Kingdom | 101/382 MV |

*Primary Examiner*—Charles Pearson

*Attorney, Agent, or Firm*—R. G. Stephens

[57] ABSTRACT

Hand-operated stamp assemblies include easily changeable magnetic rubber strips carrying raised reverse-printed printing indicia, and the strips carry forwarded-printed identifying indicia on their reverse sides. An ink pad is carried in a spring-biased hinged cover in one embodiment. Various embodiments include a handle member within which the magnetic rubber stamps may be stored and magnetically held in place.

16 Claims, 2 Drawing Sheets

PAY'T
PAST
DUE
OCT

PORTABLE HAND-OPERATED STAMPS

This application is a continuation of my copending Application Ser. No. 798,808 filed Nov. 18, 1985, which is a continuation-in-part of my copending Application Ser. No. 627,686 filed July 5, 1984 and now abandoned.

My invention relates to manual stamping or imprinting apparatus and more particularly, to an inexpensive stamp assembly which may be easily and rapidly altered to print a variety of different sets of indicia. A wide variety of hand-operated stamps are commonly used, in association with ink pads, to imprint one or more lines of text on a wide variety of receiving surfaces. For convenience of explanation, the total text or indicia which a stamp will print during the impression of the stamp at a given time will be termed the "message" then on the stamp. In various applications a user finds it desirable or necessary to print a variety of different messages. That may be accomplished, of course, by mere provision of a suitable plurality of separate hand stamps, but that tends to be costly, and in some cases utterly impractical. One general object of the present invention is to provide an improved hand stamp on which the message may be easily and rapidly altered.

Where a hand stamp is used with a variety of changeable text strips, it is desirable that a user be able to rapidly and accurately determine which text strip (or strips) is currently installed in the stamp. While the user theoretically can read the raised indicia, they are presented to the user backwards, and because the indicia are usually the same color as the background from which they extend, reading may be tedious and fraught with error. Another object of the invention is to provide a stamp assembly with changeable text strips in which installed strips may be easily identified.

Another object of the invention is to provide a hand stamp assembly in which a user may insert and remove text strips without soiling his or her fingers with ink.

Another object of the invention is to provide a hand stamp assembly incorporating an ink pad which a user can conveniently carry in his or her pocket, or in a briefcase or purse, for example.

The invention accordingly comprises the features of construction, combination of elements, and arrangement of parts, which will be exemplified in the constructions hereinafter set forth, and the scope of the invention will be indicated in the claims.

Figures 1A, 1B, 1C, 2A, 2B, 2C, 3:
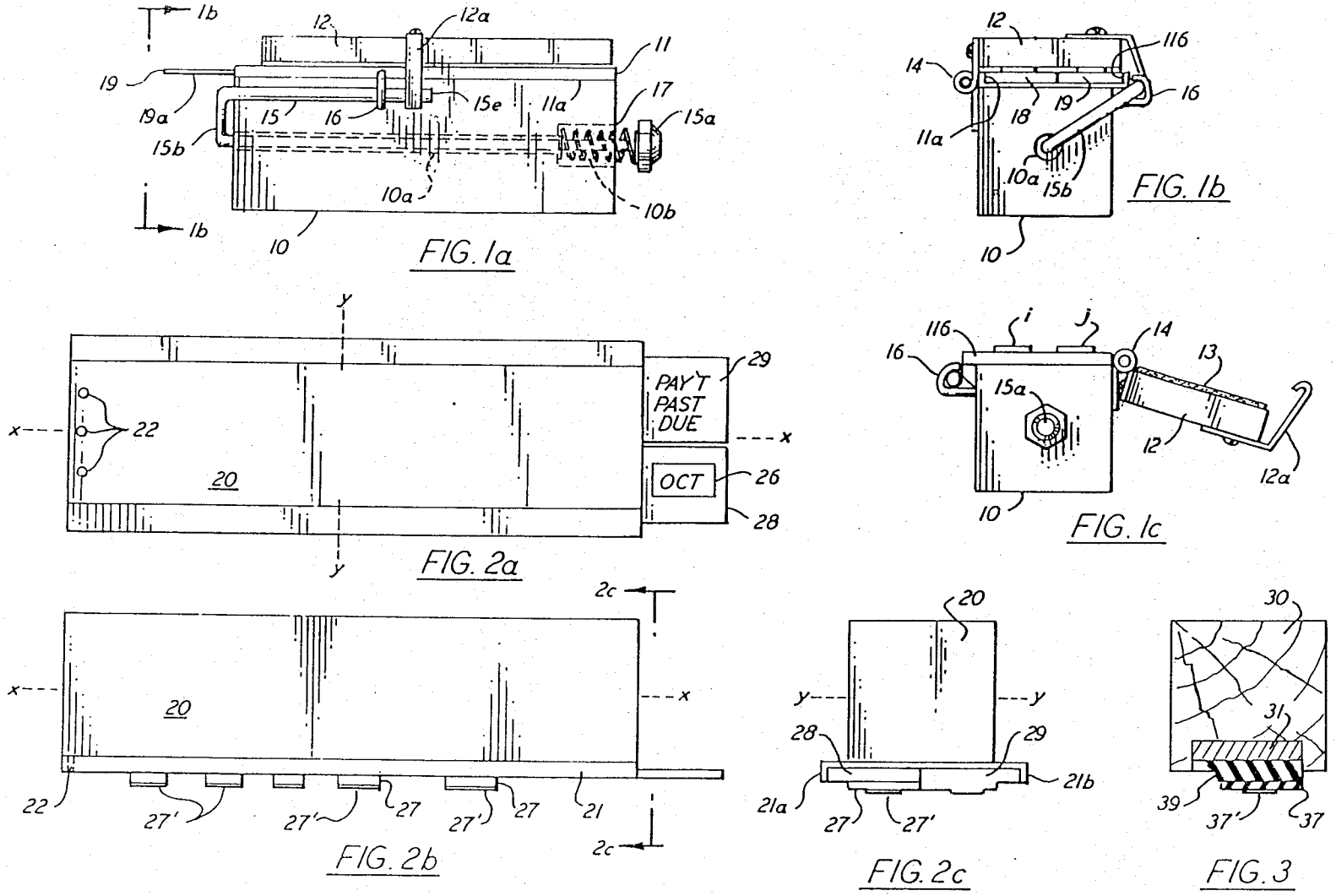
Figure 4A:
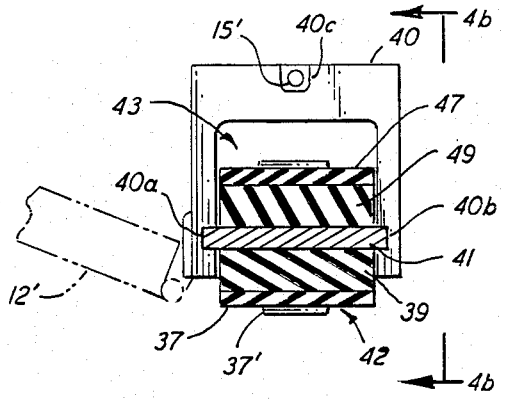
Figure 4B:
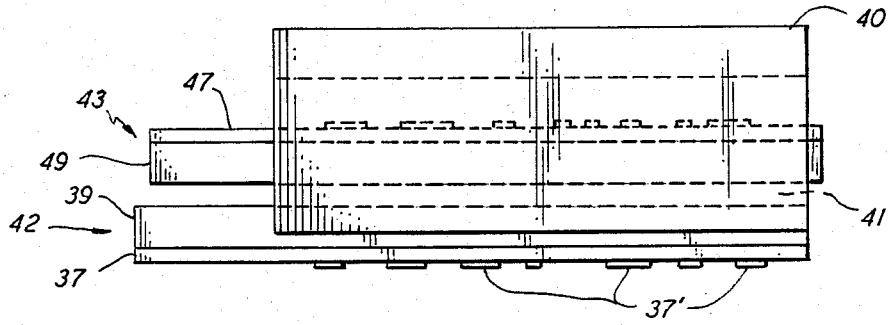

For a fuller understanding of the nature and objects of the invention reference should be had to the following detailed description taken in connection with the accompanying drawings, in which:

FIG. 1*a* is a side elevation view of a preferred embodiment of the invention;

FIG. 1*b* is an end view taken at lines 1*b*—1*b* in FIG. 1*a*;

FIG. 1*c* is an opposite-end view of the assembly of FIGS. 1*a*, 1*b* with the stamp assembly shown opened;

FIG. 2*a* is a top view of an alternative form of the invention;

FIG. 2*b* is a side elevation view of the device of FIG. 2*a*;

FIG. 2*c* is an end view taken at lines 2*c*–2*c* in FIG. 2*b*;

FIG. 3 is an end view of a further embodiment of the invention;

FIG. 4*a* is an end view of a further embodiment of the invention, and FIG. 4*b* is a view taken at lines 4*b*–4*b* in FIG. 4*a*.

Figure 5A:
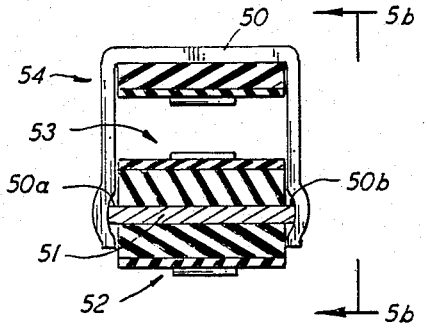
Figure 5B:
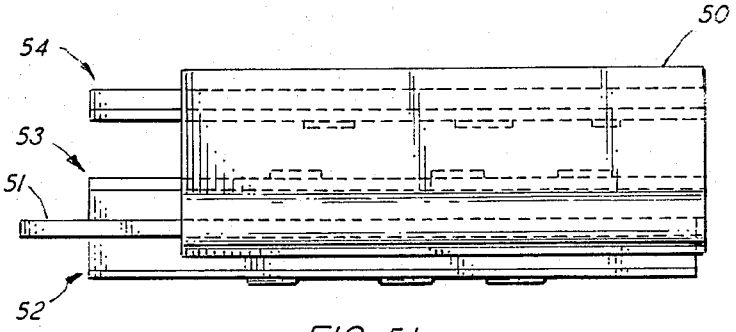

FIG. 5*a* is an end view of a further embodiment of the invention, and FIG. 5*b* is a view taken at lines 5*b*–5*b* in FIG. 5*a*.

In the stamp assembly of FIGS. 2*a*, 2*b* and 2*c*, handle member 20 is shown as comprising a rectangular wooden block, to the lower surface of which a magnetically-permeable metal (e.g., iron or steel) channel member 21 is affixed, by means of gluing, or, if desired, by screw means (not shown). Channel member 21 is coextensive in length with handle member 20, and provided with flanges 21*a*, 21*b*. Two different types of magnetic rubber strips 28,29 are shown inserted into channel 21. It will be seen that flanges 21*a*,21*b* are mutually nonreentrant, i.e., they do not lean toward each other, and hence a strip or strips located between them can be pulled upwardly out of the channel, and need not be slid lengthwise for installation or removal. A plurality of pins 22,22 staked into the underside of the web of the channel act as stop means to limit leftward (in FIG. 2*b*) insertion of magnetic rubber strips 28,29. A non-magnetic rubber strip 27 cemented to magnetic rubber strip 28 carries raised indicia 27' spaced along its length. Magnetic rubber strip 29 is shown not carrying a non-magnetic rubber strip, but having raised indicia provided on the magnetic rubber strip itself. The two different types of magnetic rubber strips are shown solely for sake of example, and two (or more) strips of the same type may be used, if desired.

Strips 28 and 29 are both provided with a length such that they protrude outside channel 21 when their other ends abut pins 22. The upper sides of the protruding portions of strips 28,29 bear indicia identifying the nature of the raised indicia carried on their opposite sides. The identifying indicia may be printed, stencilled or otherwise fixed directly on the magnetic rubber strip as is shown in the case of strip 29, or it may be carried on a paper or similar label 26 pasted on the strip, as is shown for strip 28. The identifying indicia either may repeat the raised indicia, in a smaller type and with forward printing, or it may identify the raised indicia by means of a suitable abbreviation or a simple code, and in some cases may comprise a single character or other mark. In any event, the identifying indicia may contrast starkly in color to the background on which it is presented, and since it may comprise forward printing, it may be easily read by the user with little or no chance of error. In addition to carrying identifying indicia, the portion of the strip extending beyond an end block 20 serves as a convenient un-inked handle which the user may grasp either to slide the strip lengthwise off of the metal plate, or to pull the strip off of the metal plate in a direction perpendicular to the x—x and y—y directions shown. The lengthwise direction is shown labelled x—x in FIGS. 2*a* and 2*b*, and the sidewise direction is shown labelled y—y in FIGS. 2*a* and 2*c*. The flanges 21*a*, 21*b* of channel member 21 act as stop means to limit movement of the magnetic rubber strips in both directions of the y dimension, and pins 22,22 act as stop means to limit movement in one direction of the x dimension.

In the modified embodiment illustrated in FIG. 3, the stop means comprise three ridge portions surrounding a rectangular recess formed in wooden handle member 30. A magnetically-permeable metal plate 31 is fitted within the recess, and the three ridges of member 30 extend below the lower surfaces of plate 31 to act as three stop means to limit movement of magnetic rubber strip 39 (shown partially cut away) to which is cemented a non-magnetic rubber strip 37 carrying raised indicia 37'. Strip 39 protrudes outside member 30, and its upper side carries identifying indicia (not visible in FIG. 3).

Referring to FIGS. 1*a*, 1*b* and 1*c*, a hand stamp assembly includes a handle member 10 shown as comprising a rectangular generally-solid wooden block. Affixed to one side of block 10 is a three-sided magnetically-permeable metal tray 11 having three flanges or sides 11*a*,11*b* (FIG. 1*b*) and 11*c* (FIG. 1*c*), leaving one end of the tray open, as shown in FIG. 1*b*. A pair of magnetic rubber strips 18,19 are shown laid in tray 11, to which strips 18,19 adhere by magnetic attraction. Each flexible magnetic rubber strip carries a non-magnetic rubber strip cemented thereto, with each non-magnetic rubber strip bearing raised indicia, such alphanumeric characters. In FIG. 1*c* the raised indicia are shown at i,j extending above the edges of tray 11.

A box or cover 12 carrying an ink pad 13 is hingedly connected to block 10 by means of a conventional spring-biased hinge 14, the spring (not shown) of which urges cover 12 and ink pad 13 toward the open position shown in FIG. 1*c*. Cover 12 may be rotated (counterclockwise as viewed in FIG. 1*c*) against the hinge spring force so that ink pad 13 rests atop the indicia-carrying rubber strips. As cover 12 is so rotated, a hook 12*a* on cover 12 eventually snaps over and hooks on the end of wire rod 15, locking the cover closed, in the position shown in FIGS. 1*a* and 1*b*. A wire loop 16 keeps the hinged spring force from bending the end of wire 15 upwardly (as viewed in FIGS. 1*a* and 1*b*). With cover 12 closed no portion of ink pad 13 is exposed, and hence one can carry the assembly in a pocket or purse without soiling other articles therein with ink.

Wire rod 15 extends through lengthwise bore 10*a* in block 10 and carries a release button 15*a* on one end. A compression spring 17 seated in a partial bore 10*b* in block 10 urges button 15*a* (and hence rod 15) rightwardly as viewed in FIG. 1*a*, so that the bent end 15*b* of rod 15 normally seats against the end of block 10. If the user pushes release button 15*a* inwardly toward block 10 against the force of compression spring 17, rod 15 slides leftwardly (as viewed in FIG. 1*a*), and when end 15*e* of the rod slides past hook 12*a*, cover 12 will be released, allowing hinge 14 to snap cover 12 and ink pad 13 to the open position shown in FIG. 1*c*. When it snaps open, cover 12 and ink pad 13 rotate somewhat more than 180 degrees, until a portion of the cover strikes a portion of hinge 14, as shown in FIG. 1*c*. Then one may press the freshly-inked indicia i,j down onto a desired receiving surface to print the message carried on strips 18,19. Each of strips 18,19 carries indicia on the protruding portion of its side opposite to where the raised indicia are carried, at surface 19*a* in FIG. 1*a*, for example, to identify the nature of the raised (printing) indicia. If desired, the identifying indicia can be placed on the same side of a strip as the raised indicia, but using forward printing.

In the alternative embodiment illustrated in FIGS. 4*a* and 4*b*, the handle member 40 comprises a simple U-shaped or channel member preferably made of plastic or wood. The channel member has a central web portion from which a pair of leg portions depend. The leg portions have a pair of mutually-facing slots 40*a*,40*b*, each of which extend the entire length of member 40, and between which magnetically-permeable plate 41 is seated. Plate 41 may be fixed in slots 40*a*,40*b* either by means of an adhesive or by a friction fit. The slots are situated intermediate the ends of each leg, so that the ends of the legs project beyond the plate to act as stop means, and so that a recess is provided above the plate. A first magnetic rubber strip means shown in the printing position at 42 comprises a strip 39 of magnetized rubber, to which a strip 37 of non-magnetized rubber is affixed, as by cementing, with the non-magnetized rubber strip carrying raised indicia 37'. A second magnetic rubber strip means of similar construction comprising magnetized rubber strip 49, to which non-magnetized rubber 47 is affixed, is shown at 43 in a storage position, situated largely inside handle member 40. It will be understood that magnetized strip 49 will detachably adhere to plate 41, holding the second magnetic rubber strip means in the storage position no matter the various angles to which the assembly may be tipped during use of the assembly. However, the user may readily interchange the two magnetic rubber strip means in order to print an alternate message. The assembly of FIGS. 4*a*–4*b* optionally may include a hinged ink pad, such as that partially shown in dashed lines at 12, and if such a pad is included, its operating shaft 15' may seat in a slot provided in handle member 40, as shown in dashed lines at 40*c*. The dimensions of handle member 40 may be increased, so that two or more magnetic rubber strip means may be stored inside the handle member, one magnetically adhering directly to plate 41, and one or more above it magnetically each adhering to a lower adjacent magnetic rubber strip means.

The alternative embodiment illustrated in FIGS. 5*a* and 5*b* includes a generally channel-shaped magnetically-permeable (e.g., iron or steel) handle member 50 upset to provide mutually-facing depressions 50*a*,50*b* between which magnetically-permeable metal plate 51 may be seated and held in place by the spring force of handle member 50. Three magnetic rubber strip means are shown in FIG. 5, at 52, 53 and 54. Each of the magnetic rubber strip means comprises a strip of magnetized rubber to which a strip of non-magnetized rubber is affixed, with raised indicia formed on the non-magnetized strip. The strip means 52 shown in printing position, and strip means 53 shown in storage position magnetically adhere to opposite sides of plate 51, while strip means 54, also in storage position, magnetically adheres to the handle member 50 on an inside wall of handle member 50. It will become apparent now that if the legs of channel member 50 were slightly lengthened, that added magnetic rubber strip means could be stored inside handle member 50, magnetically adhering to the legs. As seen in FIG. 5*b*, metal plate 51 is shown provided with a length exceeding magnetic rubber strip means 52 and 53. The portion of plate 51 extending beyond the pair of magnetic rubber strip means may be grasped by the user to slide plate 51, together with the pair of rubber strip means, endwise out of handle member 50, slightly spreading the legs as he does so. Such an arrangement allows the user to rapidly alternate between the printing of two different messages, with no need to touch any of the inked strip means themselves.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

I claim:

1. A portable hand-operated stamp assembly, comprising a hand-grippable handle member of magnetically permeable metal and a pair of stops, extending parallel to each other, said handle member having a generally flat receiving surface, said stops extending away from said handle member beyond said receiving surface; and a plurality of magnetic rubber strip assemblies adapted to magnetically and detachably adhere to said receiving surface of said handle member at positions fixed in a first dimension by said stops, each of said magnetic rubber strip assemblies comprising a flexible sheet of non-magnetized rubber affixed to a flexible sheet of magnetized rubber, each said sheet of non-magnetized rubber carrying raised printing indicia, each of said stops having a surface extending substantially perpendicularly away from said receiving surface, whereby said magnetic rubber strip assemblies may be moved toward and away from said receiving surface in a direction substantially perpendicular to said receiving surface, said hand-grippable handle member comprising a generally U-shaped member of magnetically attractable material having a pair of spaced-apart legs, and a plate of magnetically attractable material extended between said legs at a position intermediate the ends of said legs, said U-shaped member and said plate forming a rectangular cavity for storing at least one of said magnetic strip assemblies.

2. The portable hand-operated stamp assembly of claim 1 in which said handle member has an internal recess into which said magnetic rubber strip assemblies may be inserted to enclose the portions of said strip assemblies carrying raised indicia within said recess.

3. The portable hand-operated stamp assembly of claim 2 wherein said recess is bounded on one side by said metal plate, whereby said magnetic rubber strip assemblies may adhere to said metal plate while extending into said recess.

4. The portable hand-operated stamp assembly of claim 2 wherein said handle member is formed of magnetically permeable material, whereby said magnetic rubber strip assemblies may adhere to said handle member while extending into said recess.

5. The portable hand-generated stamp assembly of claim 1 wherein said hand-grippable handle member comprises a generally channel-shaped member having a pair of spaced-apart legs, said metal plate extended between said legs at a position intermediate the ends of said legs.

6. The portable hand-operated stamp assembly of claim 5 wherein said metal plate is resiliently gripped by spring force of said handle member and slidable in between and out from in between said legs of said handle member.

7. The assembly of claim 6 wherein the length of said metal plate exceeds the lengths of said handle member and said magnetic rubber strip assemblies.

8. The stamp assembly according to claim 1 having a third stop extending away from said handle member beyond said receiving surface to limit said position in one direction of a second dimension perpendicular to said first dimension.

9. The stamp assembly of claim 1 wherein each of said magnetic rubber strip assemblies has a pair of mutually parallel edges, whereby a plurality of said assemblies may be removably abutted together on said receiving surface to provide a plurality of parallel lines of printed indicia.

10. The stamp assembly according to claim 1 wherein each of said magnetic rubber strip assemblies carry indentifying indicia on the side of said strip assemblies opposite from said raised indicia.

11. The stamp assembly according to claim 10 wherein said raised indicia are backward-printed and said indentifying indicia are forward-printed.

12. The stamp assembly according to claim 1 wherein at least one of said stops comprises a flange formed at an edge of said metal plate.

13. The stamp assembly according to claim 1 having a cover member pivotally connected to said handle member, and an ink pad affixed to said cover member.

14. The stamp assembly according to claim 13 wherein said cover member is spring-biased away from said magnetic rubber strip assemblies, and said assembly includes a releasable latch to maintain said cover member in a position adjacent said magnetic rubber strip assemblies so that said ink pad is pressed against said raised indicia.

15. A portable hand-operated stamp assembly, comprising a hand-grippable handle member having a magnetically permeable metal plate and a pair of stops, extending parallel to each other, said plate having a generally flat receiving surface, said stops extending away from said handle member beyond said receiving surface; and a plurality of magnetic rubber strip assemblies adapted to magnetically and detachably adhere to said receiving surface of said metal plate at positions fixed in a first dimension by said stops, each of said magnetic rubber strip assemblies comprising a flexible sheet of non-magnetized rubber affixed to a flexible sheet of magnetized rubber, each said sheet of non-magnetized rubber carrying raised printing indicia, each of said stops having a surface extending substantially perpendicularly away from said receiving surface, whereby said magnetic rubber strip assemblies may be moved toward and away from said receiving surface in a direction substantially perpendicular to said receiving surface, said hand-grippable handle member comprising a generally channel-shaped member having a pair of spaced-apart legs, said metal plate extended between said legs at a position intermediate the ends of said legs, said metal plate being resiliently gripped by spring force of said handle member and slidable in between and out from in between said legs of said handle member.

16. The assembly of claim 15 wherein the length of said metal plate exceeds the lengths of said handle member and said magnetic rubber strip assemblies.

* * * * *